US005083946A

United States Patent [19]

Chester, Jr.

[11] Patent Number: 5,083,946

[45] Date of Patent: Jan. 28, 1992

[54] ELECTRICAL PLUG, LIGHT SOCKET AND RECEPTACLE APPARATUS

[76] Inventor: Lyle F. Chester, Jr., 5200 N Cr. 500 W., Muncie, Ind. 47304

[21] Appl. No.: 578,678

[22] Filed: Sep. 7, 1990

[51] Int. Cl.[5] ..... H01R 19/04

[52] U.S. Cl. ..... 439/692; 439/166

[58] Field of Search ..... 307/38, 85; 439/101, 439/105, 106, 166, 168, 693, 908, 692

[56] References Cited

U.S. PATENT DOCUMENTS

| | | | |
|---|---|---|---|
| 2,667,571 | 1/1954 | Versen | 439/101 X |
| 3,123,424 | 3/1964 | Williams | 439/693 |
| 3,710,287 | 1/1973 | Eckert | 439/693 |
| 4,094,565 | 6/1978 | Parrier et al. | 439/106 |

*Primary Examiner*—Eugene F. Desmond
*Attorney, Agent, or Firm*—Leon Gilden

[57] ABSTRACT

An electrical plug is set forth including a first blade in electrical association with a first electrical conductor member and a second divided blade associated electrically with a plurality of first and second electrical switch wires, wherein a resilient polymeric insulator strip is formed between the first and second divided blade portions to provide a plurality of switched electrical wires directed from the divided blade structure permitting electrical switching of the switched wires. The insulative member is formed to ensure securement of the plug member within the associated electric outlet. An electrical receptacle apparatus is set forth including a first slot in electrical association with a first electrical conductor member and a second slot with two electrical conductors associated electrically with a plurality of first and second electrical switch wires permitting electrical switching of the switched wires.

4 Claims, 5 Drawing Sheets

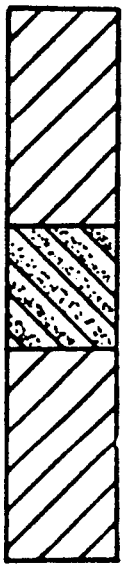
FIG. 8
FIG. 9
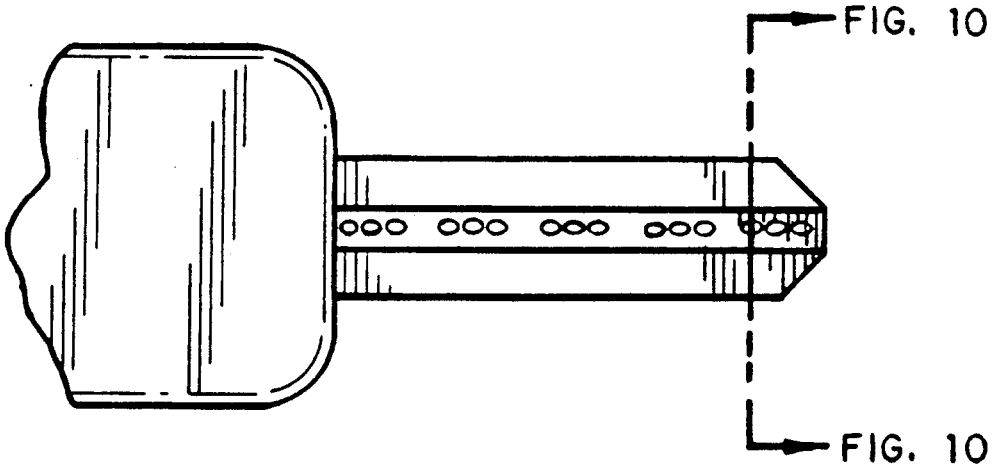
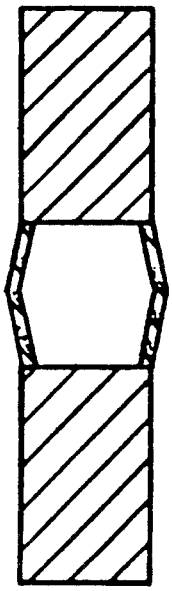
FIG. 10

ELECTRICAL PLUG, LIGHT SOCKET AND RECEPTACLE APPARATUS

BACKGROUND OF THE INVENTION

1. Field of the Invention

The field of invention relates to electrical connectors, and more particularly pertains to a new and improved electrical plug, light socket and receptacle apparatus utilizing two conductors associated with one slot permitting a plurality of switched wires directed from a common three-way switch to the divided blade members of a new and improved electrical plug utilizing a divided blade structure to permit insulative division of a plurality of switched wires directed from the divided blade member to a new and improved electrical light socket.

2. Description of the Prior Art

Various electrical connectors have been provided in the prior art to accommodate various situations requiring specific electrical association. The present invention relates to an electrical plug for securement within an associated electrical outlet to permit directing of a plurality of switches in association with a plurality of electrical appliances. Examples of prior art devices may be found in U.S. Pat. No. 4,793,059 to Moreau setting forth a grounding clip for use in association with an electrical outlet.

U.S. Pat. No. 4,392,012 to Nettel sets forth an electrical wiring box formed with an alignable grounding strap for securement to an appropriate ground of an electrical circuit.

U.S. Pat. No. 4,818,822 to Yahraus sets forth a junction box adapted for insulation to an electrical power cable in an enhanced expedient manner.

U.S. Pat. No. 4,751,610 to Nickola sets forth a utility supply pedestal utilizing a single ground wire directed therethrough.

U.S. Pat. No.4,455,449 to Rendel sets forth a high/-low voltage kit for use with a wiring box in an electrical circuit.

As such, it may be appreciated that there continues to be a need for a new and improved electrical plug, light socket and receptacle apparatus wherein the same addresses both the problems of ease of use, as well as effectiveness in construction in enhanced securement of the plug within an electrical outlet utilizing a split blade member in association with the plug.

SUMMARY OF THE INVENTION

In view of the foregoing disadvantages inherent in the known types of electrical plug structure now present in the prior art, the present invention provides an electrical plug, light socket and receptacle apparatus wherein the same permits a plurality of electrical switched wires directed from a single blade mounted within a plug member. As such, the general purpose of the present invention, which will be described subsequently in greater detail, is to provide a new and improved electrical plug, light socket, and receptacle apparatus.

To attain this, the present invention provides an electrical plug including a first blade in electrical association with a first electrical conductor member and a second divided blade associated electrically with a plurality of first and second electrical switch wires, wherein a resilient polymeric insulator strip is formed between the first and second divided blade portions to provide a plurality of switched electrical wires directed from the divided blade structure permitting electrical switching of the switched wires. The insulative member is formed to ensure securement of the plug member within an associated electric outlet.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved electrical plug, light socket, and receptacle apparatus which has all the advantages of the prior art electrical plug structures and none of the disadvantages.

It is another object of the present invention to provide a new and improved electrical plug, light socket, and receptacle apparatus which may be easily and efficiently manufactured and marketed.

It is a further object of the present invention to provide a new and improved electrical plug, light socket, and receptacle apparatus which is of a durable and reliable construction.

An even further object of the present invention is to provide a new and improved electrical plug, light socket, and receptacle apparatus which is susceptible of a low cost of manufacture with regard to both materials and labor, and which accordingly is then susceptible of low prices of sale to the consuming public, thereby making such electrical plug, light socket and receptacle apparatus economically available to the buying public.

Still yet another object of the present invention is to provide a new and improved electrical plug, light socket, and receptacle apparatus which provides in the apparatuses and methods of the prior art some of the advantages thereof, while simultaneously overcoming some of the disadvantages normally associated therewith.

Still another object of the present invention is to provide a new and improved electrical plug, light socket, and receptacle apparatus wherein the same provides enhanced securement within an associated electrical outlet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 8 is an orthographic cross-sectional view, taken along the lines 8—8 of FIG. 2, in the direction indicated by the arrows.

FIG. 9 is an orthographic top view of the split blade structure of the instant invention.

FIG. 10 is an orthographic view, taken along the lines 10—10 of FIG. 9, in the direction indicated by the arrows.

DESCRIPTION OF THE PREFERRED EMBODIMENT

Figure 1:
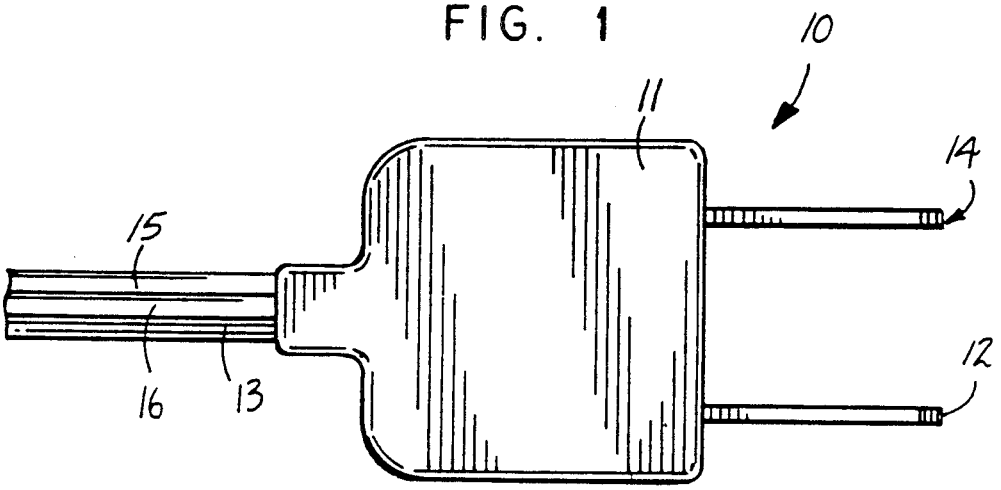
FIG. 1 is an orthographic top view of the instant invention.

With reference now to the drawings, and in particular to FIGS. 1 to 10 thereof, a new and improved electrical plug, light socket, and receptacle apparatus embodying the principles and concepts of the present invention and generally designated by the reference numeral 10 will be described.

Figure 2:
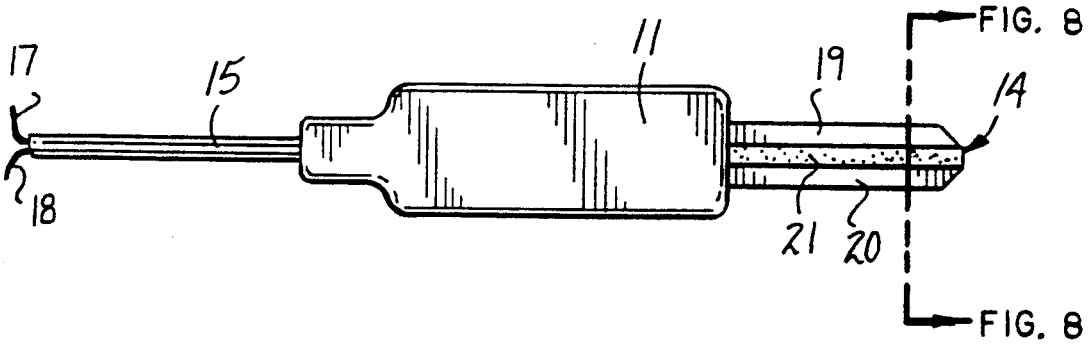
FIG. 2 is an orthographic side view of the instant invention.

More specifically, the electrical plug, light socket, and receptacle apparatus 10 of the instant invention essentially comprises an electrical plug member 11 defined by an elongate body and including a first blade 12 and a second blade 14 extending forwardly and longitudinally aligned with a plug member 11, wherein the first and second blades 12 and 14 are oriented parallel relative to one another. The first blade 12 is in electrical communication with a first electrical conductor member 13 extending rearwardly of the plug member 11, and wherein the second blade 14 is in electrical communication with a second electrical conductor member 15. A ground wire conductor member 16 is optionally provided and positioned typically medially of the first and second electrical conductor members 13 and 15 respectively. The second electrical conductor member includes a first and second electrical switched wire 17 and 18, each insulatively secured within the first and second electrical conductor member 14. Reference to FIG. 2 illustrates the second electrical conductor member 14, including a first electrical blade portion 19 in electrical communication with a first electrical switch wire 17, and a second electrical blade portion 20 in electrical communication with the second electrical switched wire 18. The first and second blade portions 19 and 20 are of a planar construction and aligned in a unitary plane relative to one another, wherein a resilient polymeric separator strip 21 is coextensively mounted between the first and second electrical blade portions 19 and 20 and in the same plane therewith.

Figure 4:
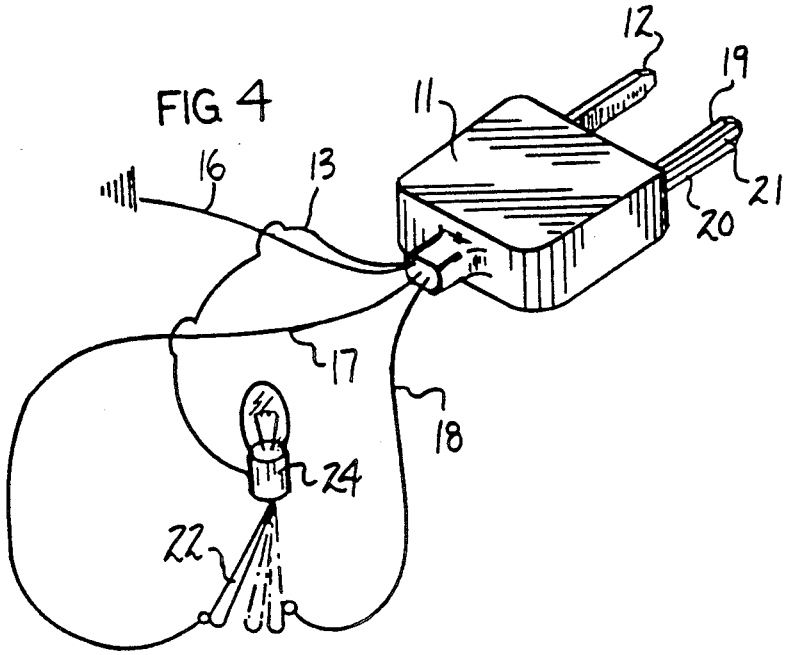
FIG. 4 is a diagrammatic illustration of the invention in association with a switch member.

FIG. 4 illustrates the first and second electrical switched wires 17 and 18 in electrical communication with a an electrical bulb 24 to illustrate the use of a three-way socket in association with the first and second electrical switched wire 17 and 18 respectively. A switch member 22 permits selective electrical association and circuit completion between the first and second switched wire 17 and 18 utilizing the first connector member 13 as a "common" wire in the circuit.

Figure 5:
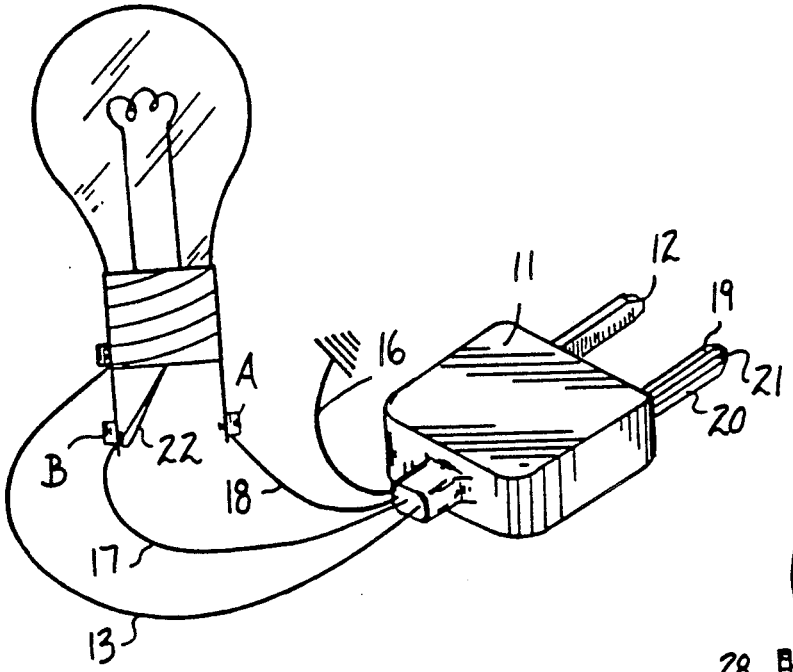
FIG. 5 is a further diagrammatic illustration of the instant invention in association with a switch member.

FIG. 5 illustrates the first and second electrical switched wire 17 and 18 in electrical communication with a three-way light socket with electrical contacts "A" and "B" respectively. A switched member 22 permits selective electrical circuit completion between the first and second electrical wire 17 and 18 utilizing the connector member 13 as a "common" wire in the circuit.

Figure 3:
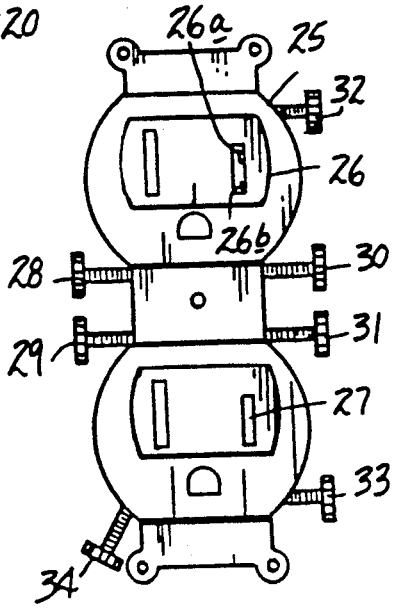
FIG. 3 is an orthographic view, taken in elevation, of an outlet receptacle for use by the instant invention.

FIG. 3 illustrates an outlet receptacle 25 in typical use by the invention, wherein first and second electrical outlets 26 and 27 are in operative association with the plug member, as illustrated in FIG. 1, wherein first and second common wire connectors 28 and 29 are in respective electrical communication with the first and second outlets 26 and 27 for association with the first electrical conductor wire member 13, and first and second switched wire connectors 30 and 31 in respective electrical communication with the first and second outlets 26 and 27 are respectively associated with a first switched wire 17, while first and second further switched wires 32 and 33 electrically cooperative with the first and second outlet members 26 and 27 respectively and are associated with the second switched wire 18. A ground wire connector 34 is utilized in compliance with conventional electrical code requirements in circuitry. It is noted that plural contact points **26*a* and 26*b* are positioned within each right hand slot of each outlet 26 and 27 to accomodate the dual contact of conductor member 14**.

Figure 6:
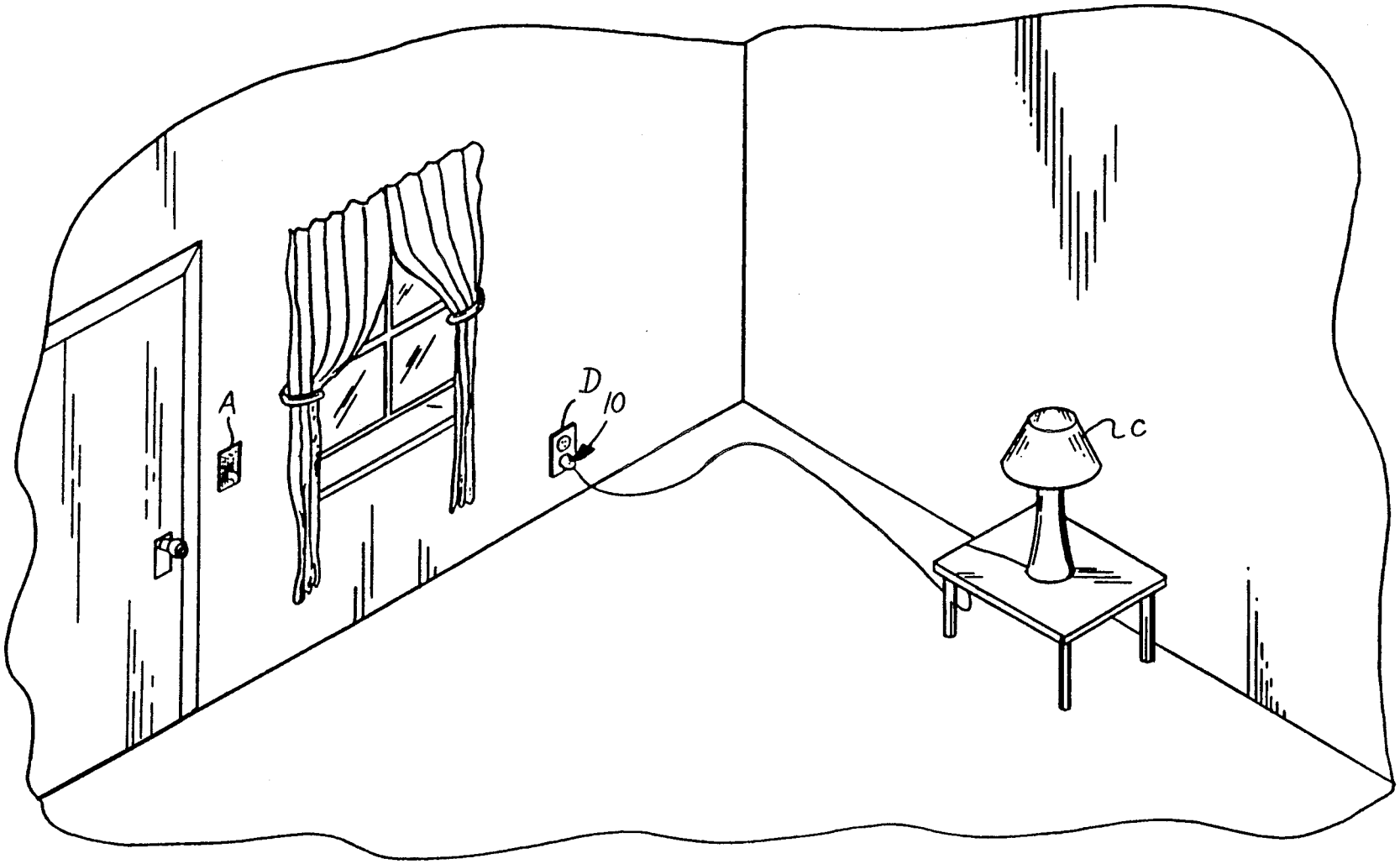
FIG. 6 is an isometric illustration of the instant invention in position within a dwelling.

FIG. 6 illustrates the use of the invention mounted within a dwelling, wherein a typical three-way switch is utilized with the receptacle "D" defined by the receptacle, as set forth in FIG. 3 of the invention, with the plug member 10 of the instant invention mounted within the receptacle. The lamp "C" includes a three-way light socket, as set forth above. When an individual enters the dwelling adjacent the switch "A", that individual may actuate the switch "A" to actuate the lamp "C". Further if an individual is positioned adjacent the lamp "C", the lamp may be illuminated by the three-way switch mounted within the lamp and accordingly may be actuated from the switch "A" or the lamp "C".

Figure 7:
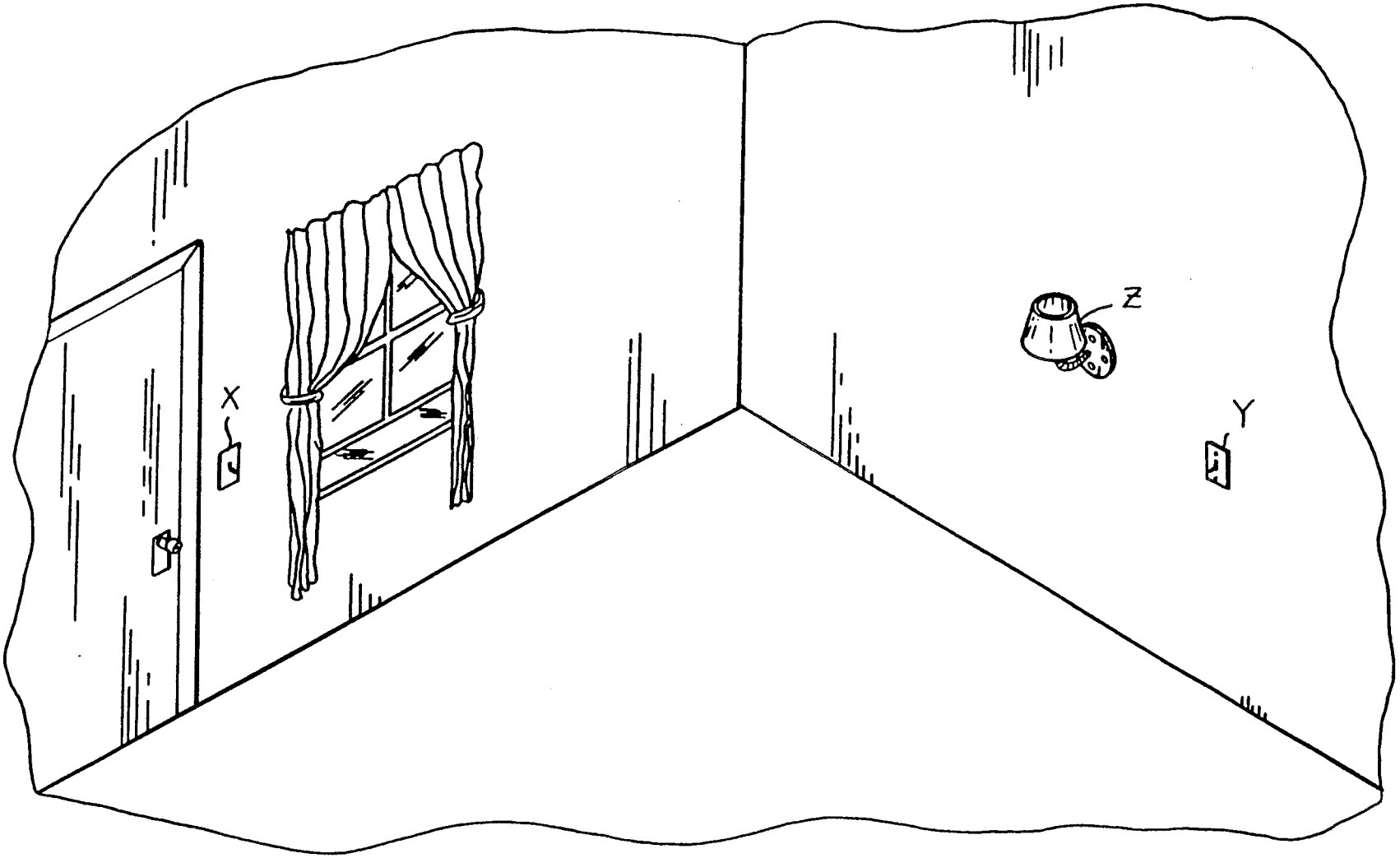
FIG. 7 is a further isometric illustration of the instant invention in position within a dwelling.

FIG. 7 illustrates a typical lighting problem in the illustrated room, wherein a three-way switch "X" and a three-way switch "Y" is provided. "Z" is a wall mounted light member. Electrical power is directed from the associated electrical panel within the dwelling to the switch "X", with a ground wire directed from "X" to the switch "Y", with a switch leg wire directed to the light "Z". With this arrangement, the light "Z" may switched from either location "X" or "Y". This may solve part of a lighting problem, but the light "Z" does not have the mobility of the lamp "C" of FIG. 6.

FIG. 8 illustrates the detail of the second blade 14, wherein the first and second blade portions 19 and 20 are separated by the resilient polymeric separator strip 21 that, as illustrated in FIG. 9, may optionally utilize air pockets 42 to permit selective compression of the modified polymeric separator strip 21, whereupon such compression of the modified separator strip 21 ensures locking engagement of the second blade 14 that is illustrated in FIG. 9 within an associated outlet, such as illustrated in FIG. 7. The air pocket structure 42, as illustrated in FIG. 10, is preferably of a width substantially equal to the predetermined width of the modified separator strip 21, as illustrated. A series of the air pocket structure 42 is coextensive with the predetermined length of the separator strip 21*a*, as illustrated.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An electrical plug apparatus comprising, in combination, an elongate plug member, including a longitudinally aligned body, including a forward terminal end, and a first blade and a second blade directed orthogonally and exteriorly of the forward terminal end of the plug member, the first blade and the second blade arranged parallel relative to one another, and the plug member including a first electrical conductor member in electrical communication with the first blade, the first electrical conductor member extending rearwardly of the plug member, and a second electrical conductor member coextensively formed with and aligned with the first electrical conductor member, including a first and a second electrical switched wire in electrical communication with the second blade, and the second blade including a first blade portion in electrical communication with the first electrical switch wire, and a second blade portion in communication with the second electrical switched wire, the first and second blades aligned in a unitary plane.

2. An apparatus as set forth in claim 1 wherein the first and second electrical blade portions are insulated relative to one another.

3. An apparatus as set forth in claim 2 wherein a resilient polymeric separator strip is mounted coextensively with and in the unitary plane defined by the first and second electrical blade portions to electrically insulate the first blade portion relative to the second blade portion.

4. An apparatus as set forth in claim 3 wherein the separator strip includes a series of air pockets formed within the separator strip.

* * * * *